United States Patent [19]

Werginz et al.

[11] Patent Number: 4,967,511

[45] Date of Patent: Nov. 6, 1990

[54] MODULAR SHUTTER ASSEMBLY

[75] Inventors: Douglas J. Werginz, Big Bend; Robert A. Mazur, Greenfield, both of Wis.

[73] Assignee: AAA Sales & Engineering, Inc., Oak Creek, Wis.

[21] Appl. No.: 369,480

[22] Filed: Jun. 21, 1989

[51] Int. Cl.[5] ..... E06B 3/34; E05F 17/00

[52] U.S. Cl. ..... 49/371; 49/74; 98/121.2

[58] Field of Search ..... 49/74, 90, 371; 98/121.2

[56] References Cited

U.S. PATENT DOCUMENTS

| | | | |
|---|---|---|---|
| 192,353 | 6/1877 | Smits . | |
| 863,573 | 8/1907 | McCord . | |
| 1,701,695 | 2/1929 | Paine . | |
| 2,230,707 | 2/1941 | Wallace . | |
| 3,451,165 | 6/1969 | O'Hair | 98/121.2 X |
| 3,653,317 | 4/1972 | Costanzo, Jr. | 98/121.2 X |
| 3,691,687 | 9/1972 | Economou | 49/74 |
| 4,251,966 | 2/1981 | Foltman | 52/473 X |

*Primary Examiner*—Philip C. Kannan

*Attorney, Agent, or Firm*—Andrus, Sceales, Starke & Sawall

[57] ABSTRACT

A modular assembly for an indoor shutter includes fully functional louvers and is assembled from extruded and/or injection molded plastic components designed to provide complete symmetry to the assembly, both side-to-side and botom-to-top. Two identical bottom (or top) half frame members are secured together with a pair of connector members. A pair of side rail channels are slid down over the ends of the bottom frame members and enclose the connector members therein. A pivotal louver and a pair of louver supports are alternately slid into the side rail channels with the louver pivots captured between cylindrical notches on the upper and lower faces of vertically adjacent louver supports. The top frame member is connected and closed off in the same manner as the bottom frame, utilizing identical components.

17 Claims, 3 Drawing Sheets

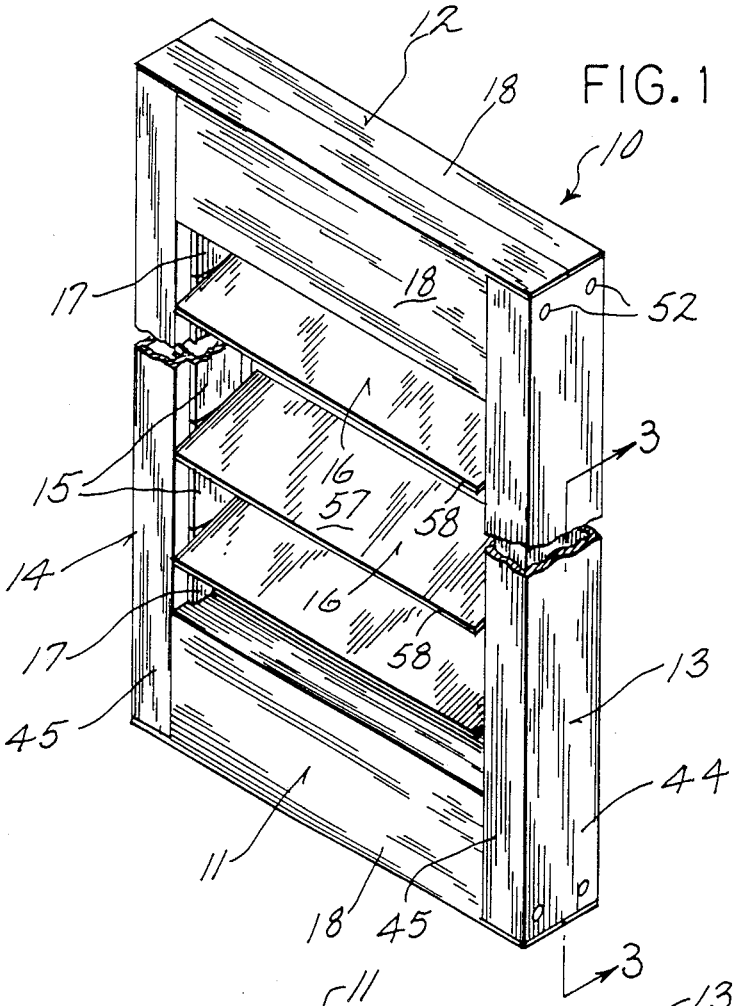
FIG. 1
FIG. 6
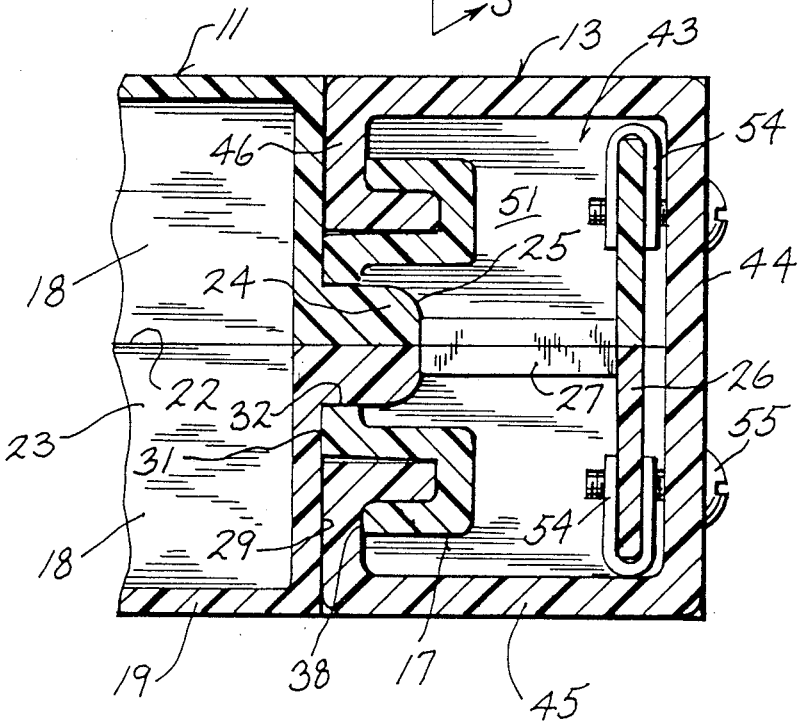

18
12
14
21
54
17
26
25
17
19
35
18
20
45
46
40
47
35
10
50
43
16
43
61
47
52
65
48
55
70
44
15
64
13
45
66
67
70
52
70
67
66
15
61
16
68
57
30
60
35
38
33
56
63
17
61
31
36
34
56
32
37
28
37
17
40
30
35
55
24
23
18
38
73
41
41
26
22
28
73
29
53
72
54
24
21
42
26
11
27
54
18
20
29
51
26
54
21
53
55

MODULAR SHUTTER ASSEMBLY

BACKGROUND OF THE INVENTION

The present invention relates to a modular assembly for a functional louvered shutter and, more particularly, to an assembly adapted to be made from extruded and molded plastic components providing substantial interassembly component identity.

Louvered shutters are used on both the interior and exterior of buildings for both decorative and functional purposes. Today, exterior louvered shutters are generally non-functional and used primarily for decorative purposes. However, interior louvered shutters often serve both a decorative and a functional purpose. Thus, interior shutters may be utilized in lieu of curtains, shades or draperies as a functional window or door cover and also provide a decorative function either when closed or opened.

The construction of functional window shutters has remained essentially unchanged for well over 100 years. Both outdoor and indoor shutters have typically been made of wood and basically include a pair of top and bottom frame members, interconnected by a pair of vertical side frame members, and a series of louvers pivotally attached by their ends between the side frame members. Also, a control bar interconnecting the ends of the louvers may be utilized to open and close the louvers in unison. U.S. Pat. No. 192,353 shows a louvered blind constructed of wood in which a portion of one side frame member to which the louver pivots are attached is removable to facilitate replacement of a damaged louver. A similar construction, also in a functional louver of wood construction in which vertical holding strips attached to the side frame members may be removed to facilitate louver replacement, is shown in U.S. Pat. No. 863,573. U.S. Pat. No. 1,701,695 also shows a functional louvered shutter made substantially of wood, but having vertical metal strips separately attached to the inside faces of the side frame members and to which the louvers are pivotally attached. This construction likewise facilitates replacement of a damaged louver. Adjustable louvered shutters in which the entire construction of both the frame and louvers are of metal is also known, as shown in U.S. Pat. No. 2,230,707.

A common characteristic of all prior art shutters, typified by those shown and described in the above identified patents, is that they are generally made to a particular size for the purpose of covering and closing a window or door opening of certain dimensions. It is also known to hinge shutters together such that arrays of two or more pairs of shutters may be utilized to provide a closure for a window opening. In all cases, the shutters must be constructed such that the shutter array essentially matches both the width and height of the window or door opening to be covered. As a result, some customization is required for nearly all functional indoor louvered shutters and the ultimate overall dimension are essentially fixed in the manufacturing process.

It is known to manufacture decorative outdoor louvered shutters of plastic and to provide some modularity such that shutters of varying height and width dimensions can be readily assembled. As indicated, however, these shutters are strictly decorative, adapted to be attached to the outside wall of the building next to a window and having fixed position louvers.

It would be desirable to be able to provide fully functional louvered indoor shutters which could be readily assembled on-sight from modular components in a manner to accommodate window or door openings of widely varying sizes. Ideally, such a modular shutter construction would be adaptable for do-it-yourself assembly and installation, and require use of no more than ordinarily available handtools.

SUMMARY OF THE INVENTION

The present invention provides a modular shutter assembly whereby a fully functional louvered shutter or array of shutters may be easily assembled to provide a functional and decorative closure for virtually any window or door opening. The assembly preferably utilizes components which are made entirely of plastic, extruded and/or molded, all of which components may be made in identical pairs to provide absolute side-to-side and top-to-bottom symmetry to facilitate assembly and minimize the number and shape of components needed. The manufacturing tooling and processes are also substantially simplified by the interassembly identity of many components and the manner in which they may be connected.

The modular assembly includes a horizontal bottom frame member to the ends of which are attached a pair of identical side frame members, each of which has a longitudinally extending open interior. A series of louver supports are specially shaped to be slid serially into the interior of the side frame members in vertical end-to-end relation in a manner such that a series of conventional louvers may be installed with the louver supports and be supported thereby between the side frame members. A horizontal top frame member, which may be identical to the bottom frame member, is identically attached by its ends to the upper ends of the side frame members. The side frame members are preferably made from extrusions such that they may be trimmed to any desired length to provide a shutter of a desired height.

The side frame members are preferably formed in the shape of a channel section with a vertically extending slot which provides an opening to the interior thereof along its full length. The side frame members are sized, shaped, and may also be finished to simulate conventional solid wood construction. The side frame members are disposed with the slots facing inwardly toward the edges of the louvers, which include conventional oppositely extending pivots on opposite ends adapted to extend into the slot for attachment to the louver supports. The louver supports are dimensioned to fit the interior of the side frame member channel so as to slide readily therein, but to be restrained from any significant lateral movement.

In the preferred embodiment, each of the louver supports includes a pair of upper and lower notches which, when the louver support is inserted into the interior of the side frame member, are disposed in alignment with the slot in the side frame member to receive the end of a louver pivot and to cooperate with an identical notch in the next adjacent louver support to enclose and support the pivot pin. The louver pivots preferably have a cylindrical shape and cooperate with similarly shaped semicylindrical notches of aproximately the same diameter.

The connections between the ends of the bottom and top frame members and the respective ends of the side frame members to which they are attached are each facilitated by an identical connector member which is adapted to be attached to an end of a bottom or top frame member and to extend axially from that attachment into the open interior of the end of the adjoining side frame member. The end of the connector member opposite its attachment to the top or bottom frame member preferably includes a semicylindrical supporting notch, like the notches in the louver supports, adapted to cooperate with such a notch to enclose and support the pivot of a louver. With the connector member attached to the end of a top or bottom frame member, the end of the side frame member in which it extends substantially encloses therein the connector member and the end of the bottom or top frame member to which it is attached.

Each of the top and bottom frame members preferably comprises a pair of identical half frame members which may be injection molded having adjoining faces which, when attached and installed, are disposed in a vertical plane lying on the center plane of the shutter. Each of the half frame members includes an integrally molded connector tab means on its opposite ends adapted to be engaged by a connector member to secure the half frame members together to form either a bottom or a top frame member. When the half frame members are joined together the resulting frame member has a substantially hollow closed interior to simulate a solid wood frame member. The connector tab means preferably comprises identical half tabs which are disposed on the adjoining faces of the half frame members such that, when the half frame members are placed together, the half tabs form a composite connector tab adapted to be received in a suitable recess in a connector member.

Suitable hinges may be readily attached to the outside faces of the side frame members of an assembled shutter, either for attachment to the frame of an opening to be enclosed or to an adjacent shutter panel to form part of a conventional shutter array. The half frame members for the top and bottom frame members may be provided in varying lengths so that shutter arrays may be assembled to accurately cover the width of virtually any window or door opening. Side frame members of any length may be utilized and cut to accommodate the connector members and louver supports required to provide a shutter of desired height. Various types of plastic may be utilized for both extruded and injection molded parts and such parts may be provided in a wide variety of decorator colors and including surface finishes to simulate wood grain and the like.

To finally secure the entire assembled shutter, screw or rivet type fasteners may be inserted through the outside face of the ends of the side frame members and into engagement with the ends of the interconnected bottom or top frame members. The shutter assembly utilizing the preferred plastic component construction readily retains its square, and will not warp, expand, or contract with changes in temperature and/or humidity.

BRIEF DESCRIPTION OF THE DRAWINGS

FIG. 1 is a perspective view of a fully assembled modular shutter assembly of the present invention.

FIG. 6 is a horizontal section taken on line 6—6 of FIG. 3.

DETAILED DESCRIPTION OF THE PREFERRED EMBODIMENT

Figure 2:
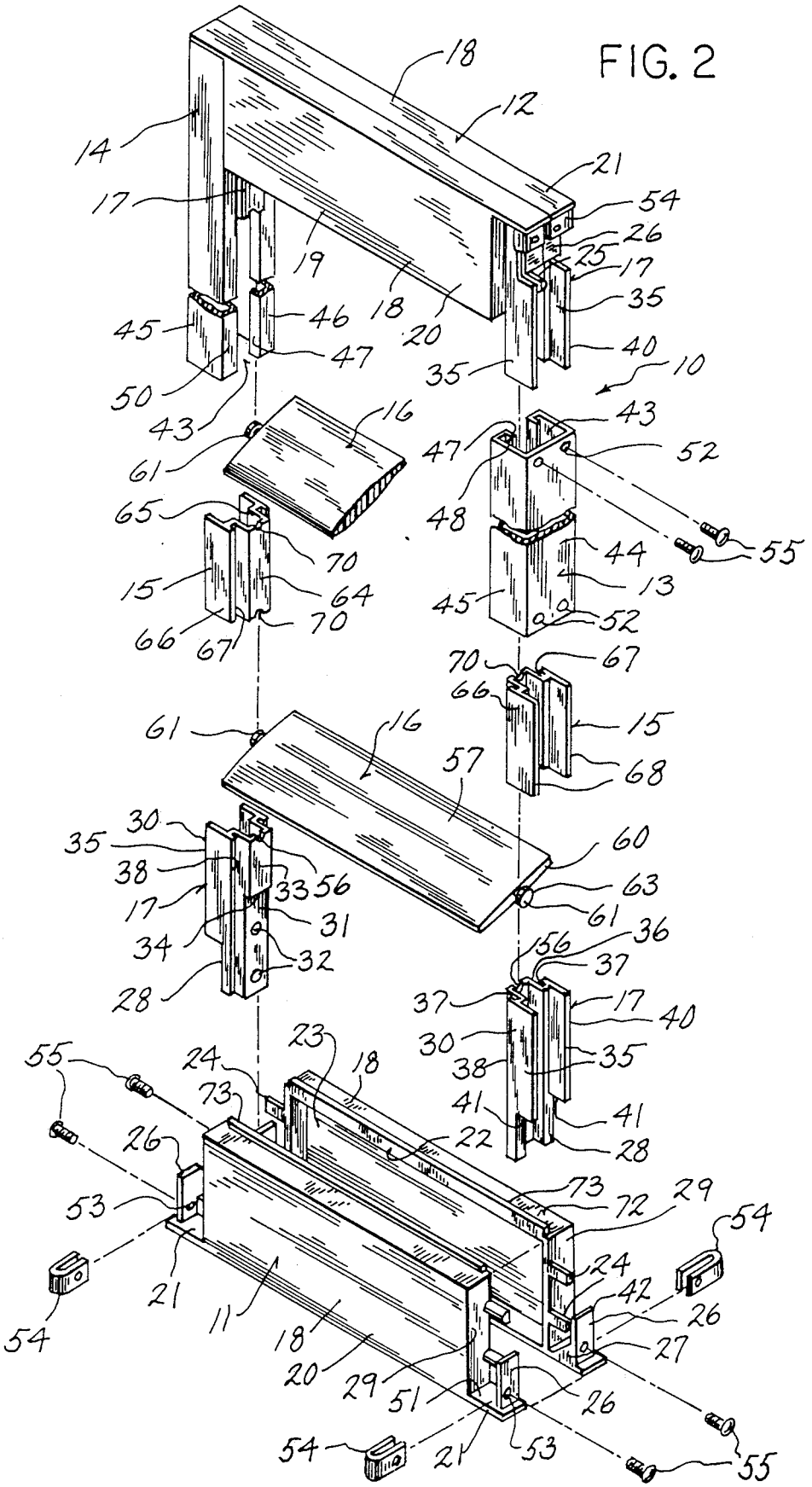
FIG. 2 is an exploded view of the shutter assembly shown in FIG. 1.

As shown in FIG. 1, the modular shutter assembly 10 of the present invention includes a pair of composite bottom and top frame members 11 and 12, respectively, which are identical in construction. The bottom and top frame members 11 and 12 are interconnected by a pair of identical side frame members 13 and 14, each having a longitudinally extending open interior adapted to receive a series of identical louver supports 15 which, in turn, pivotally support a series of horizontally disposed and vertically spaced louvers 16. The specific interconnection between each bottom or top frame member 11 or 12 and the end of a side frame member 13 or 14 is provided by a unitary connector member 17 in a manner which will be described in greater detail hereinafter.

Referring also to FIG. 2, each bottom frame member 11 is assembed as a composite from two identical half frame members 18 which are preferably injection molded from a suitable plastic, such as rigid PVC or expanded styrene. Each half frame member 18 includes a main body portion 20 and a pair of end flanges 21 on opposite ends. Each half frame member has a planar inside face portion 22 which is adapted to identically match and abut the face portion of another half frame member to form the composite bottom frame member 11. When the two half frame members 18 are brought together, the main body portions 20 completely enclose a hollow interior portion 23 and a semicylindrical projection 24 on each side of the main body portion 20 adjacent the planar face portion 22 abuts a similar projection 24 on the other half frame member to form a cylindrical connector stud 25. Similarly, the end flanges 21 of each half frame member 18 join and include an upwardly extending connector tongue 26 having an integral reinforcing gusset 27 extending between the connector tongue 26 and the end flange 21.

Each pair of half frame members 18 is preferably secured together to form the bottom frame member 11 with a connector member 17 attached to each end. Each connector member 17 includes a connecting end 28 and an integral louver end 30. The connecting end 28 includes a lower connecting face 31 having a pair of spaced holes 32 therein adapted to snugly receive the pair of cylindrical connector studs 25 at one end of the main body of the bottom frame member 11 as the lower connecting face 31 is brought down along the inside face of the connecting tongue and inwardly against the side wall 29 of the main body portion 20. In this regard, the sloping edge of the gusset 27 acts as a guiding edge to guide the holes 32 into engagement with the connector studs 25. An identical connector member 17 is attached to the opposite end of the bottom frame member 11 to similarly initially secure the half frame members 18 together.

Figure 3:
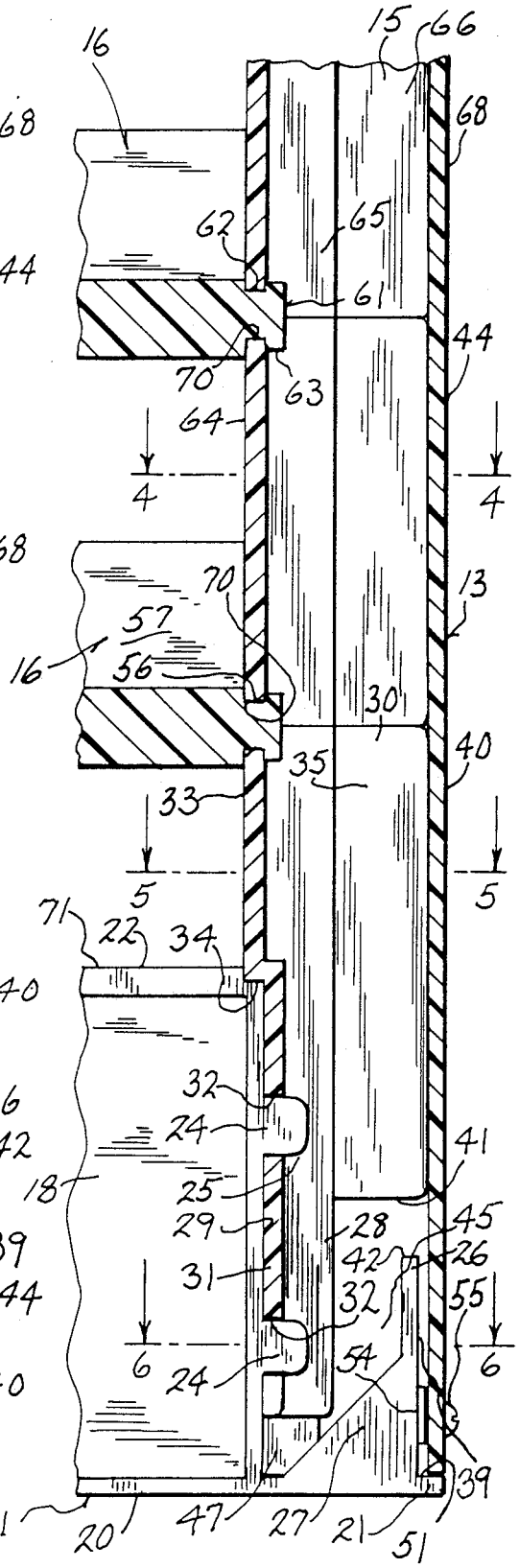
FIG. 3 is a partial vertical section through the shutter assembly taken on line 3—3 of FIG. 1.
Figure 5:
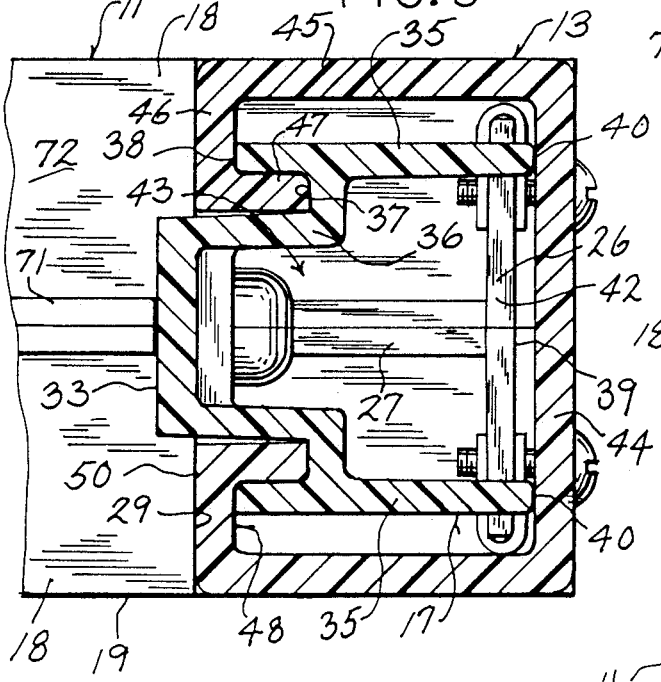
FIG. 5 is a horizontal section taken on line 5—5 of FIG. 3.

The louver end 30 of the connector member 17 includes an upper attachment face 33 which is parallel to but offset inwardly from the lower connecting face 31, to define therebetween a shoulder 34 which rests on the main body portion 20 when the connector member 17 is in place. The connector member 17 includes a pair of vertically extending side flanges 35 connected by an integral right angle web portion 36 to the upper attachment face 33 and the upper portion of the lower connecting face 31. The side flanges 35 and integral web portions 36 define a connector groove 37 along each edge of the connecting faces 31 and 33. With the connector member 17 in place and the lower connecting face 31 in engagement with the side wall 29 of the main body portion 20, the inside edge 38 of each side flange 35 is spaced from the side wall 29, as best shown in FIG. 6. The upper portions of the side flanges 35 terminate in outside edges 40 which extend slightly beyond the outside face 39 of the connector tongue 26, as shown in FIGS. 3 and 5. In addition, the side flanges are notched to provide a stepped intermediate edge 41 adapted to provide clearance for the upper edge 42 of the connector tongue 26 when the connector is completely in place.

With the bottom frame member 11 secured preliminarily by a connector member 17 attached to each end, side frame members 13 and 14 are attached to each end of the bottom frame member 11 and a connector member 17. The side frame members 13 and 14 are identical and have uniform cross sections along their entire lengths, such that they may be conveniently made by a conventional extrusion process. When viewed in cross section, each side frame member 13 or 14 comprises a generally C-shaped channel section defining a longitudinal slot 43 extending along its full length. Each side frame member includes an outer wall 44, a pair of integral side walls 45, intermediate webs 46 integrally attached to the inner edges of the side walls 45 and lying parallel to the outer wall 44, and lips 47 extending from the intermediate webs into the C-shaped channel defined by the side frame member. The lips 47, webs 46 and side walls 45 serve to define a pair of longitudinal grooves 48 extending parallel to and on each side of the slot 43.

Referring particularly to FIG. 3, a side frame member 13 or 14 is brought down over the louver end 30 of a connector member 17 to completely enclose the connector member and the connector tongue 26 extending up from the end flange 21. Referring also to FIG. 5, the interconnected parts are dimensioned such that the lips 47 on the side frame member are received in the connector grooves 37 in the connector member. The width of the side flanges 35 of the connector member are such that the inside edges 38 just clear the bottoms of the grooves 48 and the outside edges 40 engage the inside surface of the outer wall 44 of the side frame member. The edges of the lips 47 bottom in the connector grooves 37 and act with the outside edges 40 of the side flanges 35 to establish and hold the connected positions of the subassembly thus far described. At the same time, the flat outer surfaces 50 of the intermediate webs 46 engage the flat surface of the side wall 29 of the main body of the bottom frame member 11 on either side of the connector studs 25. In addition, the thickness of the lip 47 is just slightly smaller than the width of the connector groove 37, such that it will slide easily therein. In this manner, the connector member 17 is secured against axial movement off the connector studs 25 and the side frame member is positioned with respect to the bottom frame member such that the outside surface of each side wall 45 is flush with the adjacent outer wall 19 of the bottom frame member 11. As best seen in FIGS. 2 and 3, the connector tongue 26 is slightly narrower than the end flange 21 from which it depends and is also set back somewhat from the outer end of the flange such that the end of the side frame member 13 may rest flush against the upper surface 51 of the end flange 21 so that the entire outer surface of the joint has flush interconnected surfaces, so as to simulate the joint which would be attained in a solid wood construction.

At this point in the assembly of the modular shutter of the present invention, the side frame members 13 and 14 are snuggly attached to the bottom frame member 11 and the connector members 17 on each end, but because the connections are made by simply sliding the side frame members into position, as previously described, some means of securely fastening the side frame members to the bottom frame member must be provided. Referring again to FIGS. 2, 3, and 6, with the side frame member 13 or 14 in the connected position, one or more attachment holes 52 and 53 are drilled, respectively, through the outer wall 44 and the connector tongue 26 lying therebehind. The side frame member is then temporarily removed from its connected position by simply sliding it off of the connector tongue and connector member to expose the attachment holes 53 in the connector tongue 26. A pair of spring steel nuts 54 or the like, such as Tinnerman nuts, are attached over the edge of the connector tongue and in alignment with the attachment holes 53. The side frame member is then slid back into its connected position and a pair of bolts or screws 55 are inserted through the attachment holes 52 and threaded into the nuts 54 on the interior of the joint.

Figure 4:
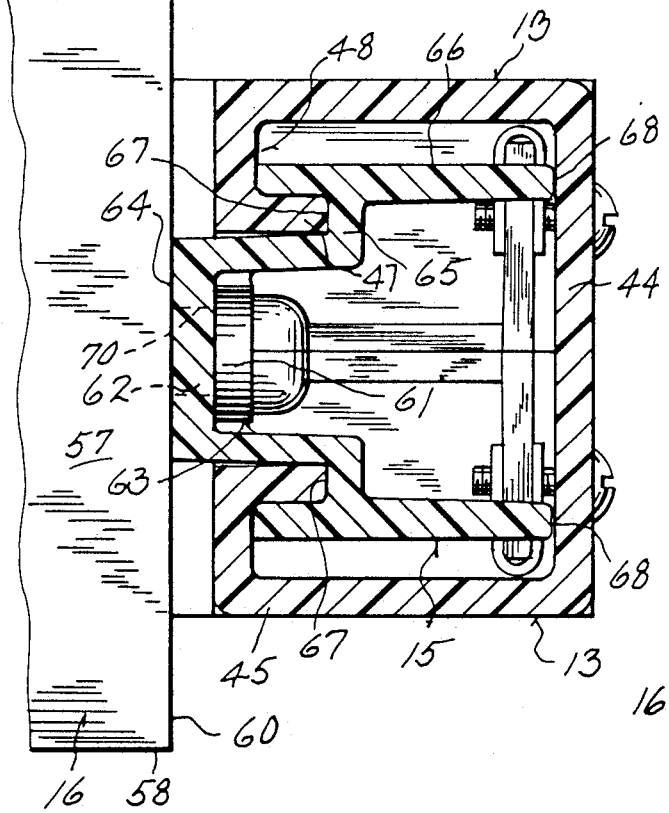
FIG. 4 is a horizontal section taken on line 4—4 of FIG. 3.

With the side frame members secured in place on the bottom frame member, the subassembly is ready for placement of the first louver 16. The upper end of the connector member 17 adjacent its upper attachment face 33 is provided with a semicylindrical groove 56 disposed generally in the center of the longitudinal slot 43 in the side frame member 13 or 14. Each of the louvers 16 includes a center blade or paddle 57 which preferably has a thicker center section and tapers slightly toward both outer edges 58. The opposite ends 60 of the paddle 57 are provided with a pair of axially aligned pivots 61 each of which includes a smaller diameter bearing surface 62 adapted to rest in the semicylindrical notch 56 in the end of the connector member 17, and a larger diameter end flange 63 adapted to engage the rear surface of the upper attachment face 33 and secure the pivot 61 in the notch 56. By carefully controlling the axial length of the bearing surface 62, i.e. the distance between the end flange 63 and the end of the louver paddle 57, surface friction between the engaging surfaces may be utilized to help control the position of the louver so that it does not rotate too easily on its pivots 61 and thereby better retains its position. With the first louver 16 in position, a louver support 15 is inserted into the open upper end of each side frame member and allowed to slide downwardly along the interior of the side frame member and into engagement with the upper edge of the connector member 17 and the louver pivot 61. Each louver support 15 may be injection molded or extruded from plastic and has a cross section virtually identical to the cross section of the upper portion of the connector member 17. However, the louver support 15 differs from the connector member 17 by virtue of its complete end-to-end symmetry. Thus, each louver support 15 includes an inner attachment face 64 joined by a right angle web 65 to a pair of side flanges 66. When viewed in cross section as shown in FIG. 4, the side flanges 66 and right angle webs 65 define a pair of longitudinally extending grooves 67 (essentially identical to the connector grooves 37) disposed on opposite sides of the connecting face 64. The attachment face 64 is adapted to be received in the longitudinal slot 43 in the side frame member, the grooves 67 receive the lips 47 and the outside edges 68 of the side flanges 66 engage the inside of the outer wall 44 of the side frame member, all in the same manner as the upper end of the connector member, previously described. Each axial edge of the attachment face 64 is provided with a semicylindrical notch 70 (identical to notch 56) which encloses and secures the upper portion of the bearing surface 62 of the louver pivot 61 previously positioned in the notch 56 in the lower connector member 17. After a louver support 15 is inserted into each side frame member 13 and 14 and slid down into position over the respective connector member 17 and louver pivot 61, another louver 16 is placed into position with its pivots disposed in the slot 43 in the side frame members and slid downwardly until the bearing surfaces 62 are received in the semicylindrical notches 70 on the exposed upper ends of the louver supports previously inserted. Another pair of louver supports is then slid downwardly into the side frame members, followed by another louver, and the process is repeated until a shutter having a desired height has been assembled.

The overall height of the modular shutter 10 may be established by providing side frame members of precut length, or the installer may appropriately cut the side frame members to the desired lengths. After the last or uppermost louver 16 has been installed, a pair of upper connector members 17 are inserted into the open upper ends of each of the side frame members in an orientation inverted from the connector members attached to the bottom frame member. Thus, the semicylindrical notch 56 in each connector member is disposed to face downwardly and engage the bearing surface 62 on the louver pivot seated in the notch 70 in the upper end of the louver support last installed. The lengths of the side frame members are carefully established such that the connecting face 31 of the connector member containing the holes 32 extends upwardly past the end of the side frame member for receipt and attachment to the top frame member 12. As previously indicated, the top frame member 12 is comprised of two identical half frame members 18 like the bottom frame member 11 and is attached to the connector members 17 and side frame members 13 and 14 in exactly the same manner previously described with respect to the bottom frame member. Thus, the composite top frame member 12 and attached connector members are slid into the side frame members 13 and 14, in a manner identical to that previously described with respect to the initial attachment of the bottom frame member. Once the top frame member is in its final position, attachment holes 52 and 53 are drilled through the adjacent outer walls 44 and connector tongues 26, the top frame member and attached connectors are temporarily removed to insert the attachment nuts 54, and then reassembled for receipt of the screws 55, again in a manner identical to that previously described with respect to the bottom frame member.

The assembled modular shutter 10 is characterized by excellent structural rigidity which resists racking and retains the assembly in virtually perfect square. The use of a modular construction comprising all plastic components totally eliminates the warping, expansion and contraction typical of wood construction, and the problems of poor fit associated therewith are, therefore, eliminated.

Shutters of virtually any height can be provided utilizing only the basic components already described. Varying shutter widths require half frame members 18 and louvers 16 of different lengths, making these the only components of the assembly requiring different sizes.

Referring to FIGS. 1 and 4, the attachment faces 64 on the louver supports 15, as well as the adjoining attachment faces 33 on the connector members 17, are dimensioned to extend inwardly through the slots 43 in the side frame members such that they are offset inwardly in the assembly from the outer surfaces 50 of the intermediate webs 46 of the side frame members. This helps assure that the frictional control of louver pivoting, previously described, is provided as intended and that the outer surfaces 50 do not interfere therewith. In addition, having the attachment faces 33 and 64 protrude inwardly, as indicated, provides a more attractive joint along the corners of the slots 43.

Conventional hinges may be utilized to attach the shutters to the casing or frame of the window or door to be covered or to interconnect adjacent shutters to provide a conventional hinged shutter array. Prior to assembly, the desired positions for the hinges are established along the outer wall 44 of the side frame member 13 or 14, holes for the hinges are drilled therein, and the hinges attached in a conventional manner using screws or bolts extending through the holes into engagement with suitable nuts held on the inside surface of the walls 44. If the nuts securing the hinge mounting screws are properly located within the large open area defined by the side flanges 66 of the louver supports and the outer wall 44 of the side frame members, the shutter may be assembled after attachment of the hinges without interference therefrom. To facilitate positioning of the hinges and the mounting holes to be drilled in the side frame members, suitable templates may be utilized. Similarly, by providing the assembler with appropriate incremental length measurements, the side frame members may be accurately cut to provide shutter assemblies of any desired length in increments equal to the length of a louver support 15.

The louvers 16 in the assembled shutter 10 may be interconnected to provide common control of their pivotal movement and positioning, in a manner well known in the art and shown, for example, in certain of the prior art patents identified hereinabove. Such a position control means may comprise, for example, a vertical control bar having common attachment to control pivots (not shown) integrally molded to the ends 60 of the louvers near one of the edges 58. The control bar may conveniently be dimensioned to fit in the space between the outer surface 50 of the intermediate web 46 and the ends of the louver paddles 57 created by the protrusion of the connecting faces 64 inwardly through the longitudinal slots 43 in the side frame members. To help provide a more complete blockage of the passage of light through the shutter assembly when the louvers are in a closed position, each of the half frame members 18 forming a part of a bottom or top frame member 11 or 12 may be provided with an integral rib 71 which extends into the frame opening and acts as a baffle when the lowermost and uppermost louvers are in their fully closed positions to eliminate any crack between their edges 58 and the adjacent surface 72 of the bottom and top frame members.

In an alternate construction, the louver supports could be made of a single unitary construction for each side of the shutter, instead of the individual louver supports 15 adapted to be inserted between each louver 16.

Thus, a modified louver support running substantially the full length of the side frame member would have a cross section essentially like that of the louver support 15, but would be provided with a series of equally spaced holes in the attachment face for receipt of the cylindrical pivots on the ends of the louvers. Obviously, the pivots would have to be constructed without the larger diameter end flanges, so that they could be inserted axially into the holes in the respective continuous louver supports. A subassembly of two continuous louver supports and a series of louvers attached thereto would then be slid simultaneously into the open upper ends of a pair of side frame members 13 and 14. Alternately, the modified louver support could also include an integral connector member on each end, which connector members would otherwise function in the manner previously described. Obviously, this modified construction would inhibit somewhat the flexibility in the selection of shutter height, but would provide the advantage of fewer total parts.

Various modes of carrying out the present invention are contemplated as being within the scope of the following claims particularly pointing out and distinctly claiming the subject matter which is regarded as the invention.

We claim:

1. A modular shutter assembly comprising:

a horizontal bottom frame member;

a pair of vertical side frame members attached to the ends of the bottom frame member, each side frame member having an open interior extending substantially its full length, said side frame members each comprising a channel section having a vertically extending slot providing an opening in the interior thereof;

a series of louver supports adapted to be slidably received in the interior of the side frame members in vertical end-to-end relation, each louver support dimensioned to fit the open interior of the side frame member in a manner to restrain said louver support from lateral movement therein;

a series of horizontally disposed vertically spaced louvers extending between the side frame members said louvers each including a pair of oppositely extending axially aligned pivots on the opposite ends thereof for attachment of the louvers to the louver supports;

notch means in the vertical ends of said louver supports for receipt of said pivots; and, a horizontal top frame member attached by its end to the upper ends of the side frame members.

2. The assembly as set forth in claim 1 wherein (each of said louver supports includes) said notch means comprises a pair of upper and lower notches in each louver support disposed in alignment with the slot in said side frame member, each of said notches adapted to receive a louver pivot and to cooperate with an identical notch in a serially adjacent louver support to enclose and support said louver pivot.

3. The assembly as set forth in claim 2 wherein said louver pivots are cylindrical in shape, and said notches are generally semicylindrical and of approximately the same diameter as said louver pivots.

4. The assembly as set forth in claim 2 including a connector member adapted to be attached to each end of the bottom frame member and the top frame member and to extend axially from its attachment into the open interior of a side frame member.

5. The assembly as set forth in claim 4 wherein the end of each connector member opposite its attachment includes a semicylindrical notch adapted to cooperate with the notch in an adjacent louver support to enclose and support a louver pivot.

6. The assembly as set forth in claim 4 wherein each bottom and top frame member end and the connector member attached thereto are substantially enclosed within the interior of said side frame member.

7. The assembly as set forth in claim 6 wherein each of said bottom and top frame members comprises a pair of identical half frame members having adjoining faces disposed in a vertical plane lying in the center plane of the shutter.

8. The assembly as set forth in claim 7 wherein each of said half frame members includes connector member tab means on its opposite ends for engagement by a connector member to secure each adjoining pair of half frame members together.

9. The assembly as set forth in claim 8 wherein said joined half frame members define a frame member having a substantially hollow closed interior.

10. The assembly as set forth in claim 8 wherein said connector tab means comprises identical half tabs disposed on the adjoining faces of the half frame members and adapted to form a composite connector stud, and further comprising recess means in said connector members for receipt of said connector studs.

11. A modular shutter assembly comprising:

a horizontal bottom frame member having a main body portion with a generally rectangular cross section and connector means attached to the ends of the body portion;

a pair of side frame members attached to said connector means and extending vertically upward from the ends of said body portion;

each side frame member having an open interior extending its full length;

each of said side frame members comprising a channel section having a slot extending its full length and providing an opening to the interior thereof;

a plurality of louver supports adapted to be slidably inserted into the open interior of said frame members and disposed in abutting end-to-end relation;

a plurality of horizontally disposed and vertically spaced louvers extending between said side frame members and supported at their ends by the louver support means;

means for pivotally attaching the louver to the louver supports comprising a pair of axially aligned pivots extending from opposite ends of said louver;

each of said louver supports including a vertical attachment face extending between its ends and lying in the slot in the side frame member, each attachment face having an upper and lower notch for receipt of a louver pivot and disposed to cooperate with an identical notch in an abutting louver support to enclose and support said louver pivot; and, a horizontal top frame member attached by its ends to the upper ends of said side frame member.

12. A modular shutter assembly comprising:

composite bottom and top frame members each formed from a pair of identical half frame members, said half frame members having adjoining faces disposed in a vertical plane lying in the center plane of the shutter;

a connector member attachable to the ends of each pair of half frame members to hold the same in their joined position;

a side frame channel having an open interior adapted to slidably receive therein the connector member and the attached ends of said half frame members;

louver support members disposed in said channel members and extending the full length thereof between the pair of connector members attached to said bottom and top frame members; and, a plurality of horizontally disposed and vertically spaced louvers extending between the channel members and supported at their ends by said louver support members.

13. The assembly as set forth in claim 12 wherein said channel members each has a vertically extending slot in communication with the open interior thereof, said slot disposed adjacent the ends of said louvers.

14. The assembly as set forth in claim 12 wherein the ends of each half frame member includes integral laterally extending projections at the adjoining face which form a composite connector stud, and said connector member includes a connecting face having openings therein for receipt of said connector studs.

15. A modular shutter assembly comprising:

a horizontal bottom frame member;

a pair of vertical side frame members attached to the ends of the bottom frame member, each side frame member having an open interior extending substantially its full length, said side frame members each comprising a C-shaped channel section defining a vertically extending slot providing full length access to the open interior thereof;

louver support means adapted to be slidably received in the interior of the side frame members and dimensioned to fit the open interior of the side frame member in a manner to interlock with portions of said C-shaped channel section and to restrain said louver support means from lateral movement therein;

said louver support means having a louver attachment face disposed within and extending along the slot in said channel section;

a series of horizontally disposed vertically spaced louvers extending between the side frame members, said louvers each including a pair of oppositely extending axially aligned pivots on the opposite ends thereof;

means for pivotally attaching said louver pivots to said louver attachment faces to allow adjustable pivotal movement in said louver and for interlocking said pivots to said louver support means to prevent axial movement of said pivots with respect to said support means and said side frame members; and, a horizontal top frame member attached by its ends to the upper ends the side frame members.

16. The assembly as set forth in claim 15 wherein said louver support means comprises:

a series of louver supports disposed in abutting end-to-end relation; and, notch means in the vertical ends of said louver supports for attaching and interlocking said pivots.

17. The assembly as set forth in claim 16 wherein said notch means comprises a pair of semicylindrical notches in the opposite ends of the attachment face on each louver support, and wherein said louver pivots each includes a cylindrical bearing surface extending axially from one end of the louver, said bearing surface supported between and semicylindrical notches of abutting louver supports, and an enlarged end flange extending axially beyond said notches, whereby said cylindrical bearing surface is secured against axial movement in said notches.

* * * * *

UNITED STATES PATENT AND TRADEMARK OFFICE

CERTIFICATE OF CORRECTION

PATENT NO. : 4,967,511

DATED : November 6, 1990

INVENTOR(S) : Douglas J. Werginz et al

It is certified that error appears in the above-identified patent and that said Letters Patent is hereby corrected as shown below:

Col. 11, line 10, (claim 12) "channel" insert --member--.

Signed and Sealed this

Seventh Day of April, 1992

*Attest:*

HARRY F. MANBECK, JR.

*Attesting Officer*

*Commissioner of Patents and Trademarks*